US009911145B2

(12) United States Patent
Argue et al.

(10) Patent No.: US 9,911,145 B2
(45) Date of Patent: Mar. 6, 2018

(54) AUTOMATIC SHARING OF A RECEIPT WITH A PLACE OF EMPLOYMENT

(71) Applicant: WAL-MART STORES, INC., Bentonville, AR (US)

(72) Inventors: Stuart Argue, Palo Alto, CA (US); Anthony Emile Marcar, San Francisco, CA (US)

(73) Assignee: WAL-MART STORES, INC., Bentonville, AR (US)

( * ) Notice: Subject to any disclaimer, the term of this patent is extended or adjusted under 35 U.S.C. 154(b) by 882 days.

(21) Appl. No.: 13/665,878

(22) Filed: Oct. 31, 2012

(65) Prior Publication Data

US 2014/0122279 A1 May 1, 2014

(51) Int. Cl.

| | |
|---|---|
| ***G07B 17/00*** | (2006.01) |
| ***G07F 19/00*** | (2006.01) |
| ***G06Q 30/04*** | (2012.01) |

(52) U.S. Cl.

CPC ..... *G06Q 30/04* (2013.01)

(58) Field of Classification Search

None

See application file for complete search history.

(56) References Cited

U.S. PATENT DOCUMENTS

| | | | | |
|---|---|---|---|---|
| 5,739,512 | A | 4/1998 | Tognazzini | |
| 6,341,353 | B1 | 1/2002 | Herman | |
| 6,487,540 | B1 * | 11/2002 | Smith | G06Q 20/02 705/21 |
| 7,487,912 | B2 | 2/2009 | Seifert | |
| 7,606,864 | B2 | 10/2009 | Koch | |
| 7,748,621 | B2 | 7/2010 | Gusler | |
| 8,090,366 | B2 | 1/2012 | McNamara | |
| 2002/0178075 | A1 | 11/2002 | Emerick et al. | |
| 2003/0033272 | A1 * | 2/2003 | Himmel | G06Q 10/02 |
| 2003/0126020 | A1 | 7/2003 | Rosner | |
| 2004/0220964 | A1 | 11/2004 | Gauthier | |
| 2005/0060261 | A1 | 3/2005 | Remington et al. | |
| 2005/0184157 | A1 | 8/2005 | Craig et al. | |
| 2006/0175403 | A1 | 8/2006 | Fossen McConnell et al. | |
| 2009/0172565 | A1 | 7/2009 | Jackson et al. | |
| 2009/0198620 | A1 | 8/2009 | Van Do | |
| 2009/0248557 | A1 | 10/2009 | Reed et al. | |

(Continued)

OTHER PUBLICATIONS

Non-Final Office Action dated Jan. 20, 2017 for U.S. Appl. No. 13/665,870.

(Continued)

*Primary Examiner* — Fateh M Obaid

(74) *Attorney, Agent, or Firm* — Bryan Cave LLP

(57) ABSTRACT

A method is disclosed for a customer sharing a receipt with other persons. An electronic receipt may be viewed on a mobile electronic device with electronic receipts software thereon. A customer may select the receipt for sharing as well as selecting modifications to the receipt and persons to share the receipt with. Information may be sent to a server or computer system to request that a receipt be shared. The server may then process the request and transmit receipt information to the contact person requested by the customer. The receipt may be shared via data transfer, facsimile or email, or may be shared through a receipts management software or application.

26 Claims, 11 Drawing Sheets

(56) References Cited

U.S. PATENT DOCUMENTS

| | | | | |
|---|---|---|---|---|
| 2009/0271303 | A1 | 10/2009 | Weng et al. | |
| 2009/0271322 | A1 | 10/2009 | Lay et al. | |
| 2009/0292595 | A1 | 11/2009 | Tonnison et al. | |
| 2010/0332240 | A1 | 12/2010 | Somuah et al. | |
| 2011/0039585 | A1 | 2/2011 | Rouse | |
| 2011/0125598 | A1 | 5/2011 | Shin | |
| 2011/0307318 | A1 | 12/2011 | LaPorte | |
| 2012/0078768 | A1 | 3/2012 | King et al. | |
| 2012/0095855 | A1 | 4/2012 | Sterling | |
| 2012/0185306 | A1* | 7/2012 | Cheng | G06Q 20/209 705/14.4 |
| 2012/0198003 | A1 | 8/2012 | Schechter | |
| 2012/0276880 | A1* | 11/2012 | Angorn | H04W 4/12 455/414.1 |
| 2012/0290438 | A1 | 11/2012 | Poniatowski | |
| 2012/0290609 | A1* | 11/2012 | Britt | G06Q 30/06 707/769 |
| 2014/0122345 | A1* | 5/2014 | Argue | G06Q 30/04 705/304 |

OTHER PUBLICATIONS

Final Office Action dated May 6, 2015 for U.S. Appl. No. 13/665,870.

Non-Final Office Action dated Jan. 20, 2016 for U.S. Appl. No. 13/665,878.

Final Office Action dated Aug. 25, 2016 for U.S. Appl. No. 13/665,870.

* cited by examiner

AUTOMATIC SHARING OF A RECEIPT WITH A PLACE OF EMPLOYMENT

RELATED U.S. APPLICATION

This application is related to U.S. application Ser. No. 13/665,870, filed Oct. 31, 2012. The application is incorporated herein by reference for all purposes.

BACKGROUND

Field of the Invention

This invention relates to receipts and receipt management systems and more particularly to systems and methods for allowing a customer to share a receipt with work.

Background of the Invention

Many point-of-sale (POS) systems currently in use today do not support important emerging technologies. For example, current POS systems are limited in their ability to handle electronic receipts and to facilitate management and sharing of receipts for transactions which generated electronic receipts. As a result, the adaptation of electronic receipts is hindered or prevented by the inability to provide the functionality associated with a paper receipts or to adequately manage electronic receipts. Accordingly, what is needed is a system and method for facilitating use of electronic receipts.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

Figure 1:
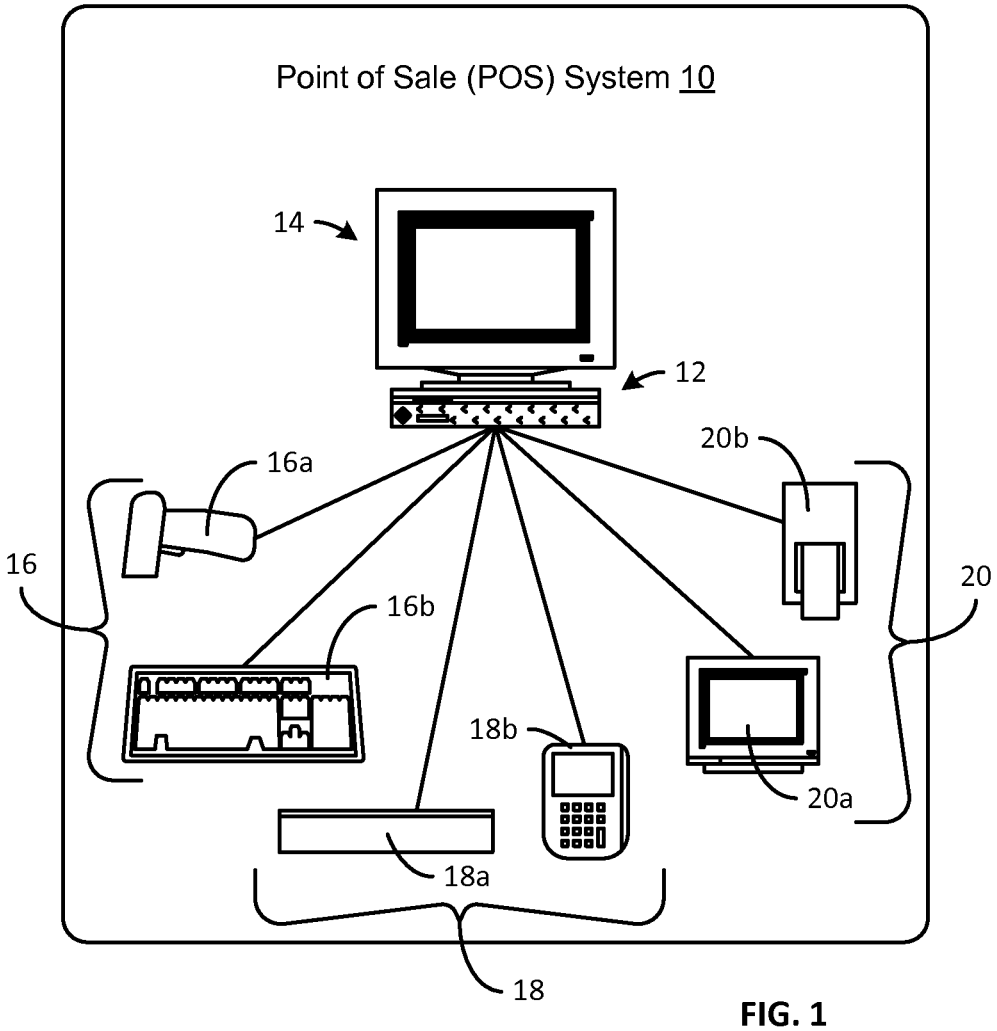
FIG. 1 is a schematic block diagram of one embodiment of a point-of-sale (POS) system for implementing methods in accordance with the present invention.

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

The invention has been developed in response to the present state of the art and, in particular, in response to the problems and needs in the art that have not yet been fully solved by currently available apparatus and methods. Accordingly, the invention has been developed to provide a system and methods for managing receipts and in particular for sharing electronic receipts with a customer's work.

In selected embodiments, a customer may utilize a mobile electronic device, such as a smart phone or tablet. An electronic receipt may be displayed or managed on the mobile electronic device and the device may include software which allows the customer to manage receipts. The software may allow the customer to interface with the electronic receipt and with the POS system.

In certain embodiments, a machine-readable code may be used to interact between the customer's mobile electronic device, receipts, and/or the POS system. The machine readable code may comprise a conventional barcode or a two-dimensional barcode (e.g., a Quick Response (QR) Code). The data encoded within a machine-readable code may vary between different embodiments and different purposes or goals of the embodiment. In selected embodiments, a machine-readable code may encode a transaction identification (ID) uniquely identifying a particular transaction (e.g., purchase, return, or the like). Alternatively, or in addition thereto, a machine-readable code may encode data regarding the POS terminal and/or the store where the terminal is located. In some embodiments, a machine readable code may be accompanied by an alpha-numeric code.

In general, the purpose of a receipts system is to facilitate handling of receipts in a manner which is convenient to the customer and which also provides a desired measure of security. Many challenges arise in using electronic receipts. In particular, the use of electronic receipts may create challenges when a customer needs to perform subsequent receipt management functions. It may be difficult for a customer to manage electronic receipts where a receipt must be provided to a place of employment, an accountant, etc.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible medium of expression having computer-usable program code embodied in the medium.

Any combination of one or more computer-usable or computer-readable media may be utilized. For example, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. In selected embodiments, a computer-readable medium may comprise any non-transitory medium that can contain, store, communicate, propagate, or transport the program for use by or in connection with the instruction execution system, apparatus, or device.

Computer program code for carrying out operations of the present invention may be written in any combination of one or more programming languages, including an object-oriented programming language such as Java, Smalltalk, C++, or the like and conventional procedural programming languages, such as the "C" programming language or similar programming languages. The program code may execute entirely on a computer of a point-of-sale (POS) system, partly on a POS computer, as a stand-alone software package, on a stand-alone hardware unit, partly on a remote computer spaced some distance from the POS computer, or entirely on a remote computer or server. In the latter scenario, the remote computer may be connected to the POS computer through any type of network, including a local area network (LAN) or a wide area network (WAN), or the connection may be made to an external computer (e.g., through the Internet using an Internet Service Provider).

Embodiments can also be implemented in cloud computing environments. In this description and the following claims, "cloud computing" is defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions or code. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Referring to FIG. 1, in selected embodiments, the hardware, software, or hardware and software of a POS system 10 may be configured to implement one or more methods in accordance with the present invention. For example, a POS system 10 may be manufactured, programmed, modified, or upgraded to support providing electronic receipts to customers and to facilitate subsequent management of the receipt. In particular, a POS system may allow a customer to provide receipt information to other persons such as work, an accountant, etc. In discussing the present system, it is appreciated that the system may involve one or more parts of a local POS terminal and associated computers or servers, remote computers or servers, customer devices such as a mobile electronic device, and associated equipment.

A POS system 10 in accordance with the present invention may include various components. In certain embodiments, a POS system 10 may include a central or primary computer 12, a monitor 14 (e.g., a cashier-facing monitor 14), one or more input devices 16 (e.g., scanners 16*a*, keyboards 16*b*, scales, or the like), one or more payment devices 18 (e.g., cash drawers 18*a*, card readers 18*b*) for receiving or returning payments, one or more output devices 20 (e.g., customer-facing display 20*a* or monitor 20*a*, receipt printer 20*b*), or the like or combinations or sub-combinations thereof.

A computer 12 may form the primary processing unit of a POS system 10. Other components 16, 18, 20 forming part of a POS system 10 may communicate with the computer 12. Input devices 16 and certain payment devices 18 may feed data and commands to a computer 12 for processing or implementation. For example, a scanner 16*a* may pass data communicating the identity of one or more items to be purchased, returned, or the like to a computer 12. Similarly, a card reader 18*b* may pass payment information to a computer 12.

Conversely, output devices 20 and certain payment devices 18 may follow or implement commands issued by a computer 12. For example, a cash drawer 18*a* may open in accordance with the commands of a computer 12. Similarly, a customer-facing display 20*a* and receipt printer 20*b* may display or output data or information as instructed by a computer 12.

In selected embodiments, in addition to handling consumer transactions (e.g., purchases, returns), a POS system 10 may also provide or support certain "back office" functionality. For example, a POS system 10 may provide or support inventory control, purchasing, receiving and transferring products, or the like. A POS system 10 may also store sales and customer information for reporting purposes, marketing purposes, receivables management, trend analysis, cost analysis, price analysis, profit analysis, or the like. If desired or necessary, a POS system 10 in accordance with the present invention may include an accounting interface to pass certain information to one or more in-house or independent accounting applications. A POS system 10 may also communicate with third parties and may transmit receipt information and facilitate customer management of receipts.

Figure 2:
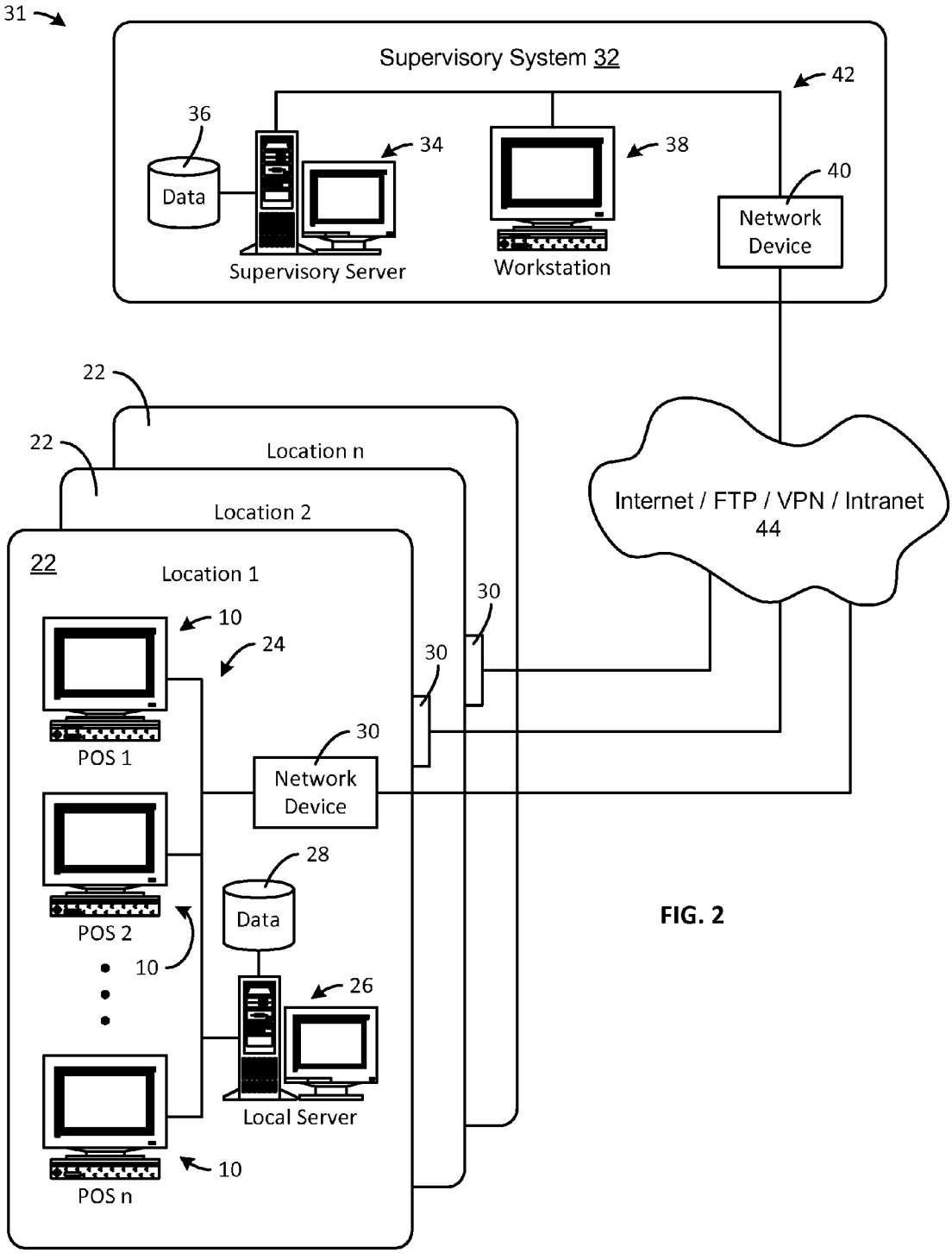
FIG. 2 is a schematic block diagram of one embodiment of multiple POS systems in accordance with the present invention operating in the context of an enterprise-wide system.

Referring to FIG. 2, in selected embodiments, a POS system 10 may operate substantially independently, as a stand-alone unit. Alternately, a POS system 10 in accordance with the present invention may be one of several POS systems 10 forming the front line of a larger system. For example, multiple POS systems 10 may operate at a particular location 22 (e.g., within a retail, brick-and-mortar store). In such embodiments, the various POS systems 10 may be interconnected via a LAN 24. A LAN 24 may also connect the POS systems 10 to a local server 26.

A local server 26 may support the operation of the associated POS systems 10. For example, a server 26 may provide a central repository from which certain data needed by the associated POS systems 10 may be stored, indexed, accessed, or the like. A server 26 may serve certain software to one or more POS systems 10. In certain embodiments, a POS system 10 may offload certain tasks, computations, verifications, or the like to a server 26.

Alternatively, or in addition thereto, a server 26 may support certain back office functionality. For example, a server 26 may receive and compile (e.g., within one or more associated databases 28) data from the various associated POS systems 10 to provide or support inventory control, purchasing, receiving and transferring products, or the like. A server 26 may also receive and compile sales and customer information for reporting purposes, marketing purposes, receivables management, trend analysis, cost analysis, price analysis, profit analysis, or the like.

In certain embodiments, one or more POS systems 10 or servers 26 corresponding to a particular location 22 may communicate with or access one or more remote computers or resources via one or more network devices 30. For example, a network device 30 may enable a POS system 10 to contact outside resources and verify the payment credentials (e.g., credit card information) provided by a customer. A network device 30 may comprise a modem, router, or the like.

In selected embodiments, a POS system 10 in accordance with the present invention may operate within an enterprise-wide system 31 comprising multiple locations 22 (e.g., branches 22 or stores 22). In such embodiments, each location 22 may have one or more POS systems 10, local servers 26, local databases 28, network devices 30, or the like or combinations or sub-combinations thereof connected by a computer network (e.g., a LAN 24). Additionally, each such location 22 may be configured to interact with one or more supervisory systems 32. For example, multiple branch locations 22 may report to an associated "headquarters" location or system 32.

A supervisory system 32 may comprise one or more supervisory servers 34, databases 36, workstations 38, network devices 40, or the like or combinations or sub-combinations thereof. The various components of a supervisory system 32 may be interconnected via a computer network (e.g., a LAN 42). In selected embodiments, a supervisory system 32 may comprise one or more supervisory servers 34 providing a central repository from which certain data needed by the one or more POS systems 10 or local servers 26 may be stored, indexed, accessed, or the like.

Alternatively, or in addition thereto, a supervisory server 34 may receive and compile (e.g., within one or more associated databases 36) data from the various associated POS systems 10 or local servers 26 to provide or support inventory control, purchasing, receiving and transferring products, or the like. A supervisory server 34 may also receive and compile sales and customer information for reporting purposes, marketing purposes, receivables management, trend analysis, cost analysis, price analysis, profit analysis, or the like.

A supervisory system 32 may be connected to one or more associated locations 22 or branches 22 in via any suitable computer network 44 (e.g., WAN 44). For example, in selected embodiments, one or more locations 22 may connect to a supervisor system 32 via the Internet. Communication over such a network 44 may follow any suitable protocol or security scheme. For example, communication may utilize the File Transfer Protocol (FTP), a virtual private network (VPN), intranet, or the like.

It is thus appreciated that in discussing the functionality of the various POS terminals and servers, the present invention may be implemented in a system contained within a single location or across multiple locations. By way of example, the functionality accomplished by a server or computer, such as storing, processing, and transmitting/sending receipt information, may be accomplished by a local computer or a remote computer such as servers 26 and 34.

Figure 3:
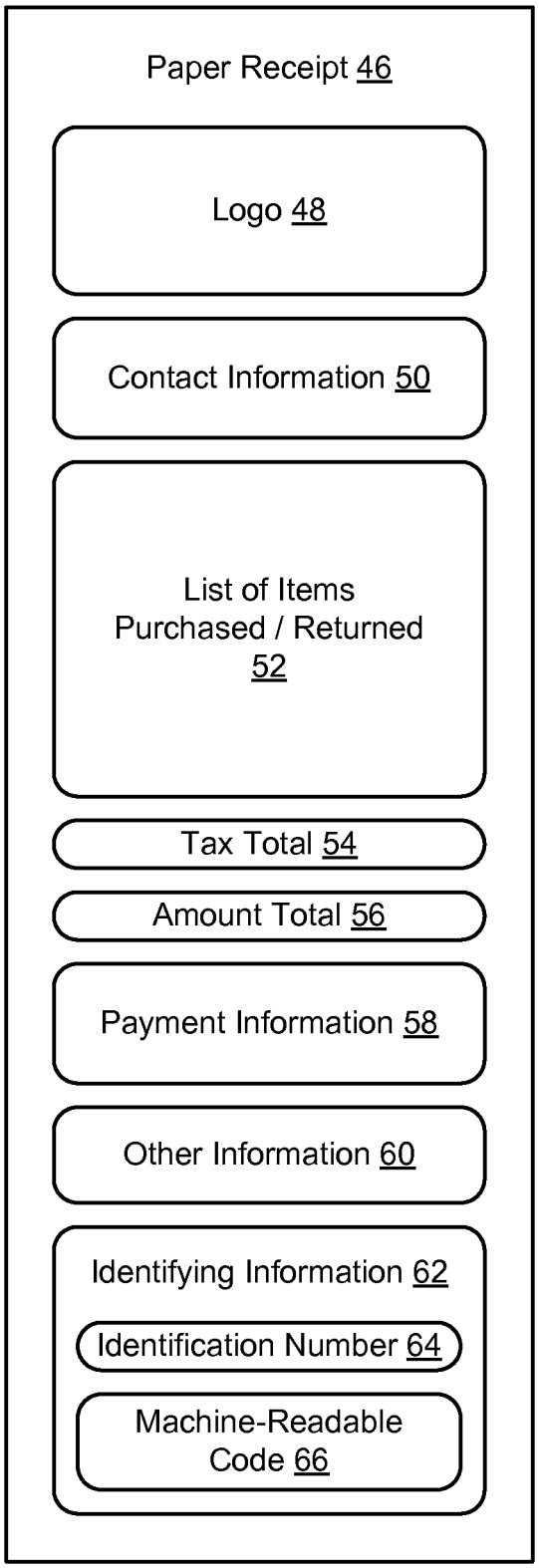
FIG. 3 is a schematic block diagram of one embodiment of a receipt in accordance with the present invention.

Referring to FIG. 3, in selected embodiments in accordance with the present invention, a POS system 10 may output a receipt 46. For example, a printer **20*b* of a POS system 10 may output a paper receipt 46. A receipt 46 may perform various functions. Primarily, a receipt 46 may document a financial transaction (e.g., sale or return). In selected embodiments, a receipt 46 may include a logo 48, contact information 50, a list 52 of items purchased or returned, a total 54 indicating the sales tax assessed or returned, a total 56 indicating 56 the amount paid or returned, payment information 58, other information 60**, or the like or combinations or sub-combinations thereof.

By including store contact information 50 on a receipt 46, an entity may ensure that a customer has ready access to one or more physical addresses, Internet address, telephone numbers, facsimile numbers, hours of operation, or the like or combinations or sub-combinations thereof. One or more of a list 52 of items purchased or returned, a total 54 indicating the sales tax assessed or returned, a total 56 indicating 56 the amount paid or returned, and payment information 58 (e.g., date of transaction, an indication of method of payment, an indication of which credit or debit card was used, etc.) may be included to document important details of a transaction.

Other information 60 may be included within a receipt 46 as desired or necessary. In selected embodiments, a receipt 46 may include identifying information 62. Information 62 may include an identification number 64 which identifies the particular transaction associated with the receipt 46. Additionally, the identifying information 62 may include a machine-readable code 66. The code 66 may also provide information to identify the transaction associated with the particular receipt 46. The identifying information may include information such as the store where the items were purchased, the time of purchase, the total price of the transaction, etc.

A machine-readable code 66 may comprise a barcode. For example, in certain embodiments, a machine-readable code 66 may comprise a two-dimensional barcode. Two-dimensional barcodes may support or provide more data per unit area than can be obtained using a traditional one-dimensional barcode. Moreover, two-dimensional barcodes are typically configured to be scanned using a camera, an item that is commonly found on personal electronic devices. A two-dimensional barcode for use in accordance with the present invention may follow any suitable protocol, format, or system. In selected embodiments, a two-dimensional code may be embodied as a Quick Response (QR) Code.

Figure 4:
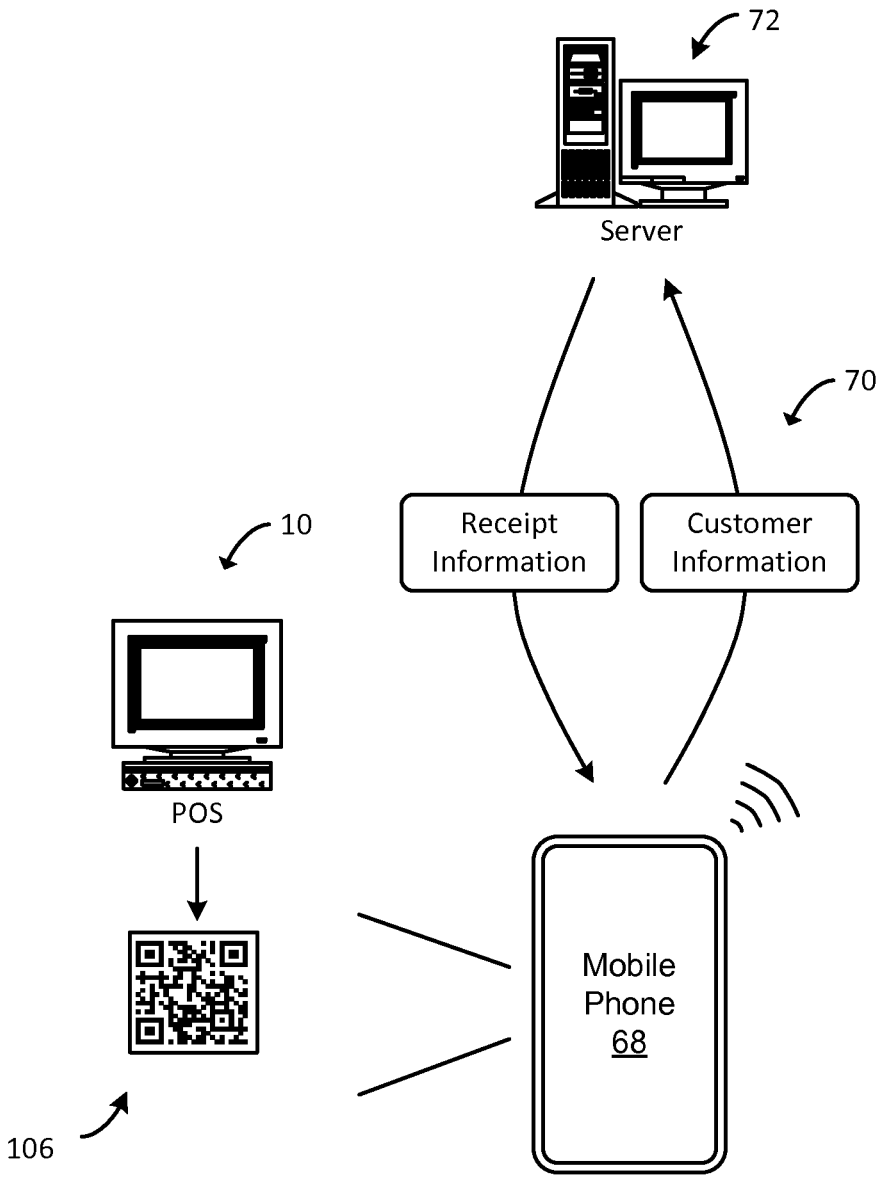
FIG. 4 is a block diagram illustrating the flow of data within one embodiment of a system in accordance with the present invention.

Referring to FIG. 4, a customer may download or may already have downloaded electronic receipts software to a mobile electronic device 68. The mobile electronic device 68 may be a smart phone, tablet PC, etc. A customer may have previously received a paper receipt 46 which includes an invitation to use electronic receipts instead of paper receipts and may have installed electronic receipts software on the mobile electronic device 68.

As indicated at 70, the customer may have an account with the computer server 72 and may transmit information to the server 72. It will be appreciated that the functionality of server 72 may be implemented by servers 26, 34, etc. The computer server 72 may likewise transmit information to the mobile device 68. The customer may receive electronic receipts on the mobile device 68 and the electronic receipts software on the mobile device 68 may enable them to manage electronic receipts. Additionally, the electronic receipts software may allow the customer to interact with a POS system 10 via the mobile electronic device 68.

Figure 5:
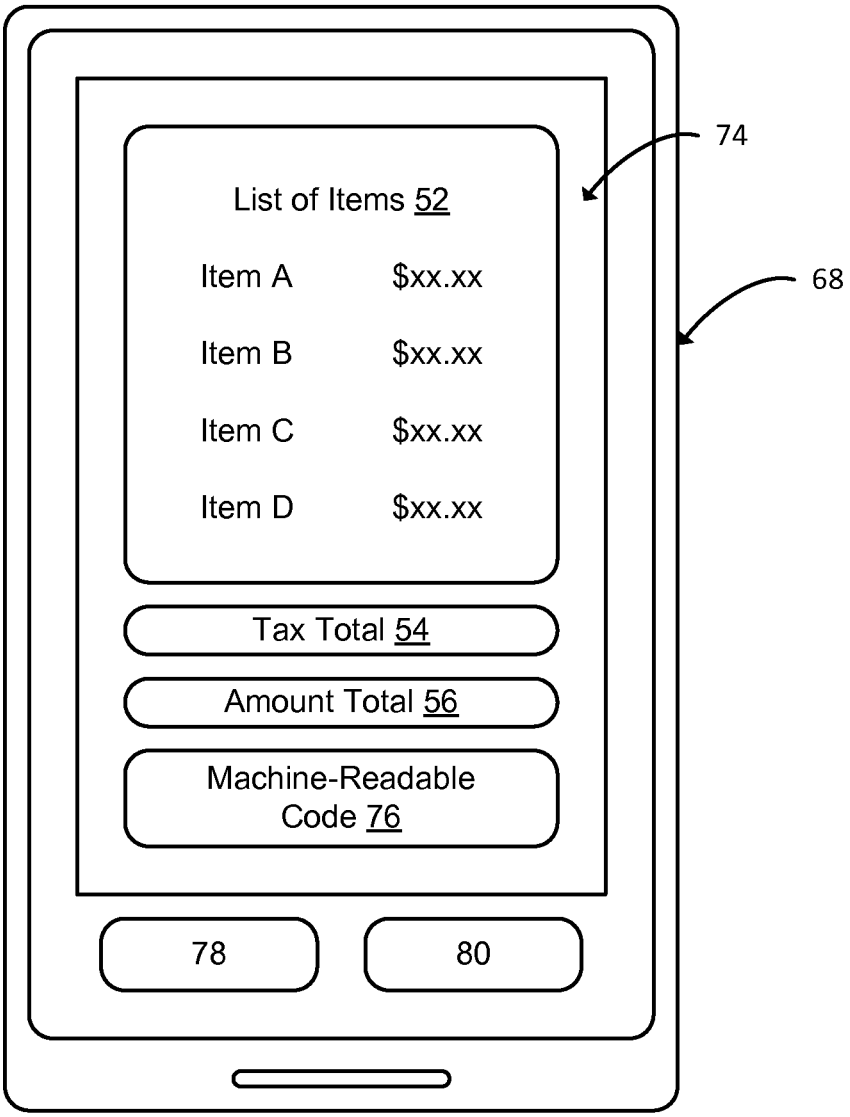
FIG. 5 is a schematic block diagram of one embodiment of a receipt viewed on a mobile electronic device in accordance with the present invention.

Referring to FIG. 5, the mobile electronic device 68 may display an electronic receipt 74 to the customer in a manner similar to the appearance of a paper receipt 46. The electronic receipts software on the mobile electronic device 68 allows a person to view their electronic receipts and to manage their receipts in many ways similar to a paper receipt. The software may provide menus, commands, or virtual buttons 78, 80 to the customer to facilitate completion of the various steps for managing electronic receipts which are discussed herein.

Figure 6:
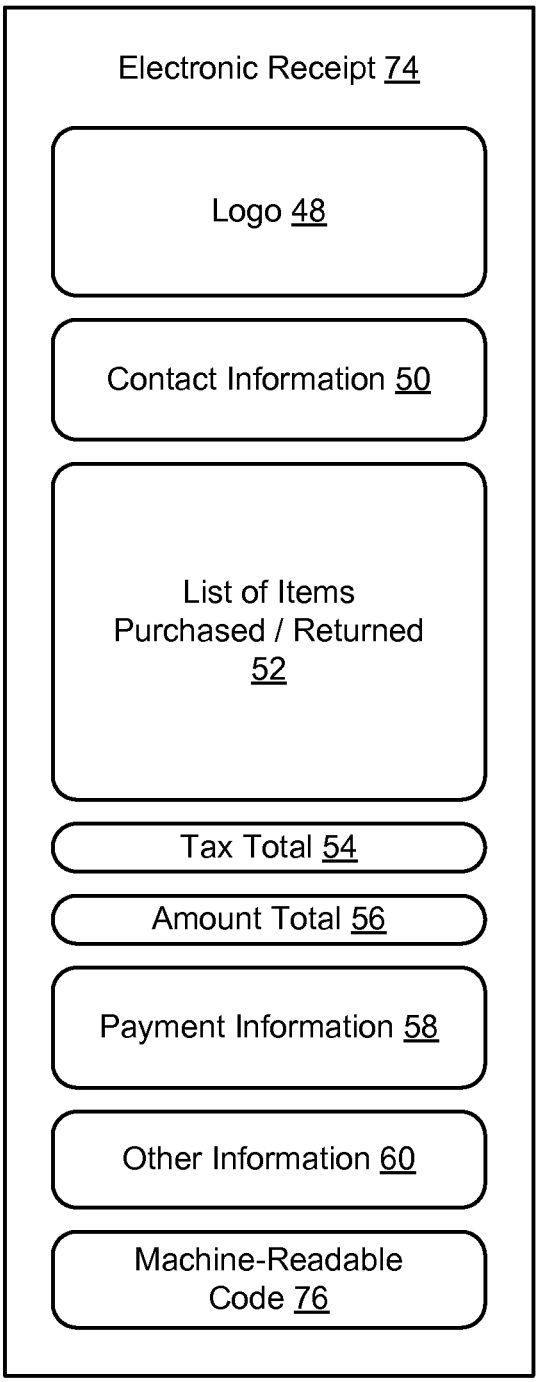
FIG. 6 is a schematic block diagram of one embodiment of a receipt in accordance with the present invention.

Referring to FIG. 6, the electronic receipt 74 is shown in greater detail. As discussed, a POS system 10 may output an electronic receipt 74 to a customer who has elected to receive an electronic receipt instead of a paper receipt. An electronic receipt 74 is often presented to a customer in a manner which is similar to a paper receipt 46. The electronic receipt 74 may include a store logo 48, contact information 50, a list 52 of items purchased or returned, a total 54 indicating the sales tax assessed or returned, a total 56 indicating 56 the amount paid or returned, payment information 58, a machine readable code 76 identifying the transaction, and other information 60 as desired, as well as combinations or sub-combinations thereof.

A machine-readable code 76 may comprise a barcode. For example, in certain embodiments, a machine-readable code 76 may comprise a conventional barcode or a two-dimensional barcode such as a QR code. Two-dimensional barcodes may support or provide more data per unit area than can be obtained using a traditional one-dimensional barcode. Moreover, two-dimensional barcodes are typically configured to be captured using a camera, an item that is commonly found on personal electronic devices. A two-dimensional barcode for use in accordance with the present invention may follow any suitable protocol, format, or system. In selected embodiments, a two-dimensional code may be embodied as a Quick Response (QR) Code.

As regards the management of electronic receipts, the data encoded within a machine-readable code 76 may encode a transaction identification (ID). A transaction ID may uniquely identify a particular transaction (e.g., a transaction documented by a corresponding receipt 74). The machine-readable code 76 may include a data hash of desired information describing the purchase transaction. For example, the code 76 may contain the store and POS terminal where the transaction occurred, the time of the transaction, the total price of the transaction, etc. With such information, a receipt and associated transaction may be positively identified for management and further use of then receipt.

The use of electronic receipts may conserve natural resources by reducing the need for and consumption of paper. Electronic receipts may also enable a consumer to more easily track and keep a highly detailed record of his or her spending. In some situations, a customer may desire to share or submit a receipt to another entity such as their workplace, an accountant, etc. The customer may desire to submit a receipt for reimbursement, accounting, etc.

Figure 7:
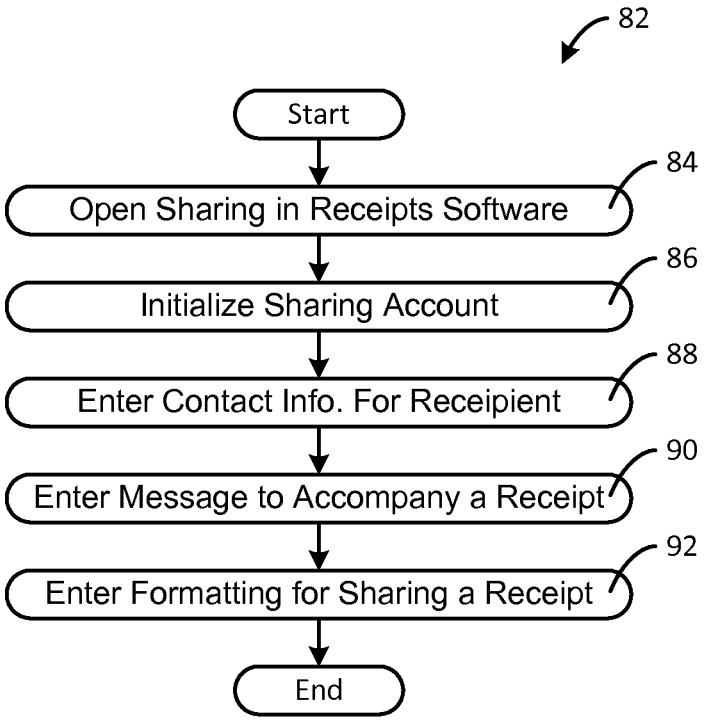
FIG. 7 is a block diagram of one embodiment of a method for initializing a receipt sharing profile in accordance with the present invention.

Referring to FIG. 7, a customer may use the electronic receipts software to manage their electronic receipts and more specifically to share a receipt with another person or entity such as their workplace. FIG. 7 generally illustrates a process 82 which may be used to initialize the electronic receipts software to share receipts with another person or entity. The electronic receipts software may include a button for sharing, or may include a list or menu option for allowing a person to share a receipt. A customer may open 84 a sharing option within the electronic receipts software. The customer may then initialize 86 a sharing profile for a person or entity such as their workplace. The customer may enter 88 the name of a contact person to whom the shared receipts will be sent. The customer may also enter another piece of information to identify a contact for receipt sharing, such as an account number with the receipts management server. Additionally, the customer may enter contact information 88 such as the person's title or position within a company as well as the person's email address or fax number. Additionally, the electronic receipts software may allow the customer to enter a message 90 to accompany the shared receipt. The customer may enter a message indicating who the receipt is from, that the receipt is for reimbursement, etc. The customer may also select 92 a format for sharing a receipt with the person. The customer may select the preferred mode of delivery such as by email or fax. The customer may also select a preferred data format. By way of example, the customer may select sending an image of the receipt such as a JPEG or PDF image or may select sending the receipt as structured data such as delimited data including XML data, comma or space delimited values, etc. as well as other structured data such as spreadsheet data, etc.

The electronic receipts software may allow the customer to initialize receipt sharing select contacts from contact information stored on the mobile electronic device 68. By way of example, the mobile electronic device may be a mobile telephone. As such, the mobile electronic device would typically have contact information for the customer's friends or work colleagues. When the customer uses the electronic receipts software to initialize receipt sharing profiles, the electronic receipts software may ask the customer if they wish to share receipts with existing contacts which are stored on the mobile electronic device. If the customer elects to share receipts with a contact which is already on their electronic device 68, the customer may select that contact while creating the receipt sharing profile. The electronic receipts software may then utilize available information from the contact and allow the customer to enter in any additional information which is necessary.

Figure 8:
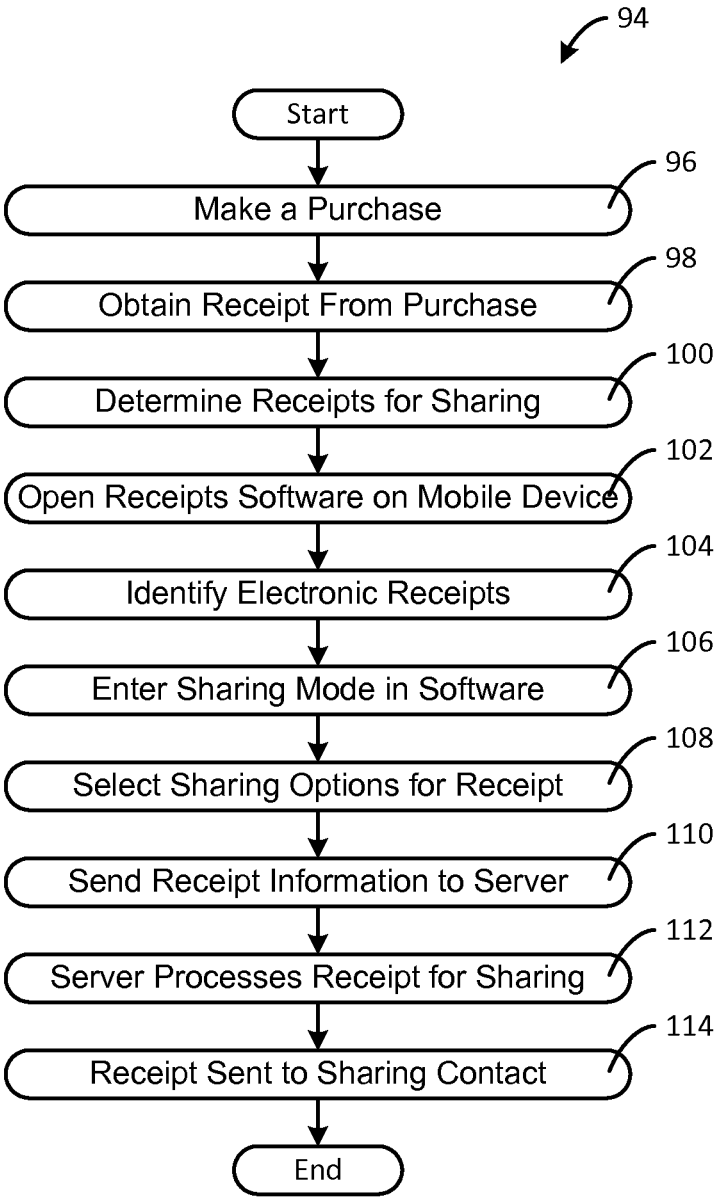
FIG. 8 is a block diagram of one embodiment of a method for sharing a receipt in accordance with the present invention.

FIG. 8 generally illustrates a process 94 which may be used to share one or more items from a receipt with another person or entity. With electronic receipts software, the customer may have access to a receipt 46, 74 on their electronic device 68. In order to make the receipts more usable to the customer, it is desirable to provide enhanced functionality as compared to simply providing the customer with an image of the receipt. The software may perform many functions allowing the customer to perform tasks such as reviewing receipts, and also allowing the customer to print paper receipts with the electronic receipt.

Generally, a person will first make a purchase 96. The purchase may include one or more items, and in some cases the purchase may include items which need to be shared (such as items purchased for work reimbursement) and personal items which do not need to be shared. After making a purchase, the customer will typically receive 98 a receipt. Where a customer has already elected to receive electronic receipts, the customer will typically receive an electronic receipt 74. The electronic receipt is typically sent to the mobile electronic device from a receipts management server 72.

According to one aspect of the present invention, the electronic receipts software may ask the customer if they want to share the receipt with their work or another contact. If the customer has previously shared receipts for items which have now been purchased, the electronic receipts software may ask the customer if they want to share the current receipt with that contact. If the customer has set up a sharing profile for their work, the electronic receipts software may ask them if they desired to share a receipt where that receipt contains items likely to be shared such as office supplies. If a customer purchases items which are typically business purchases, the electronic receipts may ask the customer if they would like to share the receipt with their work and may, if appropriate, introduce the customer to the receipts sharing functionality of the electronic receipts software and prompt the customer to initialize a receipts sharing profile for their work.

A customer may determine 100 if they have any receipts for sharing. There may be many reasons why a customer would need to share a receipt. They may need to share a receipt for accounting, reimbursement, taxes, etc. Depending on the reason for sharing a receipt, the receipt may be shared in a different manner. If the customer needs to share a receipt, they may open 102 electronic receipts software on a mobile electronic device in order to manage their receipts. They may then identify 104 one or more electronic receipts for sharing. The person may enter 106 a receipt sharing feature within the electronic receipts software and may indicate selected receipts for sharing. It will be appreciated that these steps need not be performed in a single order. For example, a customer may select a receipt and then indicate that that receipt needs to be shared within the receipts management software.

The electronic receipts software may allow the customer to select one or more receipts in different manners. For example, the software may allow the customer to select the last receipt for sharing. The software may allow the customer to select multiple receipts for sharing, such as selecting all receipts in a given time period for sharing.

In selecting a receipt for sharing, the customer may determine that a receipt should be shared for a particular purpose. The customer may need to submit a receipt to their employer for a reimbursement, or may need a paper receipt for other tax or accounting purposes. Where a customer purchased additional personal items in the same transaction, the customer may not want those items included on the receipt which is submitted. The electronic receipts software may thus allow the customer to select a purpose for submitting the receipt and modify the presentation or the content of the receipt. The electronic receipts software may allow the customer to select a receipt and indicate that the receipt should be separated to show different items on different shared receipts or that a redacted version of the receipt should be printed. After selecting the receipt, the electronic receipts software may allow the customer to indicate which items should appear on the redacted receipt and share a receipt that shows those items along with the associated taxes, etc.

The electronic receipts software may allow a customer to establish many of these preferences while creating the sharing profile associated with a particular person or entity. If a receipt is to be shared with an accountant for tax purposes, the customer may desire to share an image of the receipt rather than a data string. In this case, the customer may select that the receipt may be shared in an image form such as by transmitting a fax image of the receipt or by sending a PDF image of the receipt via email.

The customer would then typically select 136 sharing options for sharing the receipt. The customer may select who the receipt is shared with. In one configuration, a customer may select a receipt and then select a person to share that receipt with. In another configuration, the customer may select a person to share a receipt with and then select a receipt to share with that person. The receipt and the person are thus associated with each other in the electronic receipts software. The customer may also select particular items on the receipt for sharing. In some cases, the customer may have purchased personal items and work items on the same transaction, and may desire to submit a redacted receipt to work (or to another person with whom the receipt needs to be shared). The customer may use the electronic receipts software to select particular items on the receipt for sharing.

The customer may also use the electronic receipts software to associate additional information with particular items on the receipt. The customer may enter budget reasons or purchase codes into the electronic receipts software and the software may save the entered information as data or metadata associated with the receipt or with the receipt sharing transaction. The customer may enter a message or additional data associated with the receipt.

The customer may, as part of initializing the sharing profile or as part of sharing a particular receipt, enter information about the format for transmitting the receipt. The customer may enter a preferred mode of sharing the receipt, such as sharing the receipt via fax or via email. The customer may enter a desired format for sharing the receipt. In some situations, the customer may desire to send the receipt in a graphical representation of the original receipt so that the person receiving the receipt may view the receipt in the same or a similar form as to how the receipts are issued from the store. In other situations, the information from the receipt may be shared in a different format. The information from the receipt may be shared in a spreadsheet format or may also be shared in a delimited data format such as XML or csv data. This data may be transferred to the contact person through facsimile, email, delivery to a particular computer data storage medium, etc.

It will be appreciated that different data formats may be better suited to different delivery methods. For example, fax delivery of the receipt information to another person may be best suited to transmitting an image of the receipt or a spreadsheet page providing the receipt information. Email delivery of the receipt information may be better suited to transmitting a data file containing the receipt information. Both methods, however, may provide the additional information discussed.

According to one aspect of the present invention, the process for sharing a receipt may often include the customer making a purchase and receiving an electronic receipt 74 on their mobile electronic device 68. The customer may then go into a list mode or a selection mode with electronic receipts software on their mobile electronic device and select items on that receipt which are for work. The customer may then input a command to share the receipt with work. Sharing and receipt information is then sent to a receipts management server 72. According to formatting and information setting associated with the customer's work sharing profile, the receipt may then be processed by the server 72 and the shared receipt is sent to the contact person at the customer's work. A shared copy of the receipt and/or receipt information is sent to that contact person showing the desired items and information.

The electronic receipts software may send 110 the information associated with sharing the receipt from the mobile electronic device 68 to a receipts management server 72. In one embodiment of the present invention, the mobile electronic device may transmit the information to the server 72 over its own network. The server 72 may then process 112 the receipt sharing request. In processing the receipts sharing request, the server may receive receipt identification information to identify the particular receipt/transaction. The server would also receive the information associated with sharing the receipt, such as the contact information for the person who will receive the shared receipt and the customized information associated with the sharing profile and that a customer may have entered in association with the particular receipt.

The server 72 may then process the information to provide this information in a manner which is useful. The server may create a version of the receipt for sharing which includes the additional item and receipt associated information. This information may be provided in varying formats according to the delivery of the shared receipt information. If the receipt is shared as an image, codes or information associated with a particular item may be printed on the receipt image next to that item. If the receipt is shared as a spreadsheet or data file, the associated information may be in an adjacent cell or adjacent data value.

The server 72 may modify the receipt or the receipt information to make the receipt more useful for the person who receives the shared receipt. By way of example, the server may modify the items listed on the receipt to show a more complete item description to make it clear to the contact person what the items are, what the item and package quantity is, etc. The server may modify the receipts to include full tax information for the items on the receipts. Where different types of items have different sales tax amounts, the receipt may be modified to show the particular sales tax associated with each item.

The server 72 may also modify the receipt or append additional information to the transmitted receipt to indicate the customer identity. The server may include the name, telephone number, and/or email address of the customer who is sharing the receipt. When the customer is selecting a receipt for sharing, the electronic receipts software may include tick boxes or prompt the customer to indicate if they desire to share their name, telephone number, email, etc. The server may also append advertising information to the shared receipt. For example, if the server 72 determines that a certain product has been purchased for the company once or multiple times, the server may offer a coupon or a discount for purchasing that product in bulk or may indicate to the contact person that an item is currently on sale at the store or the store's internet site.

After preparing the shared receipt the server 72 may then transmit 114 the shared receipt to the contact associated with the sharing profile created by the customer. Where the receipt is shared by fax, the server 72 may uses communications devices such as a network enabled fax machine or an electronic fax account to transmit the shared receipt information to the contact person. Where the receipt is shared by email, the server may use communications devices such as a modem to transmit the email to the contact person. The shared receipt may then be received by the contact person associated with the receipt sharing profile and that person may process and utilize the receipt as desired.

Figure 9:
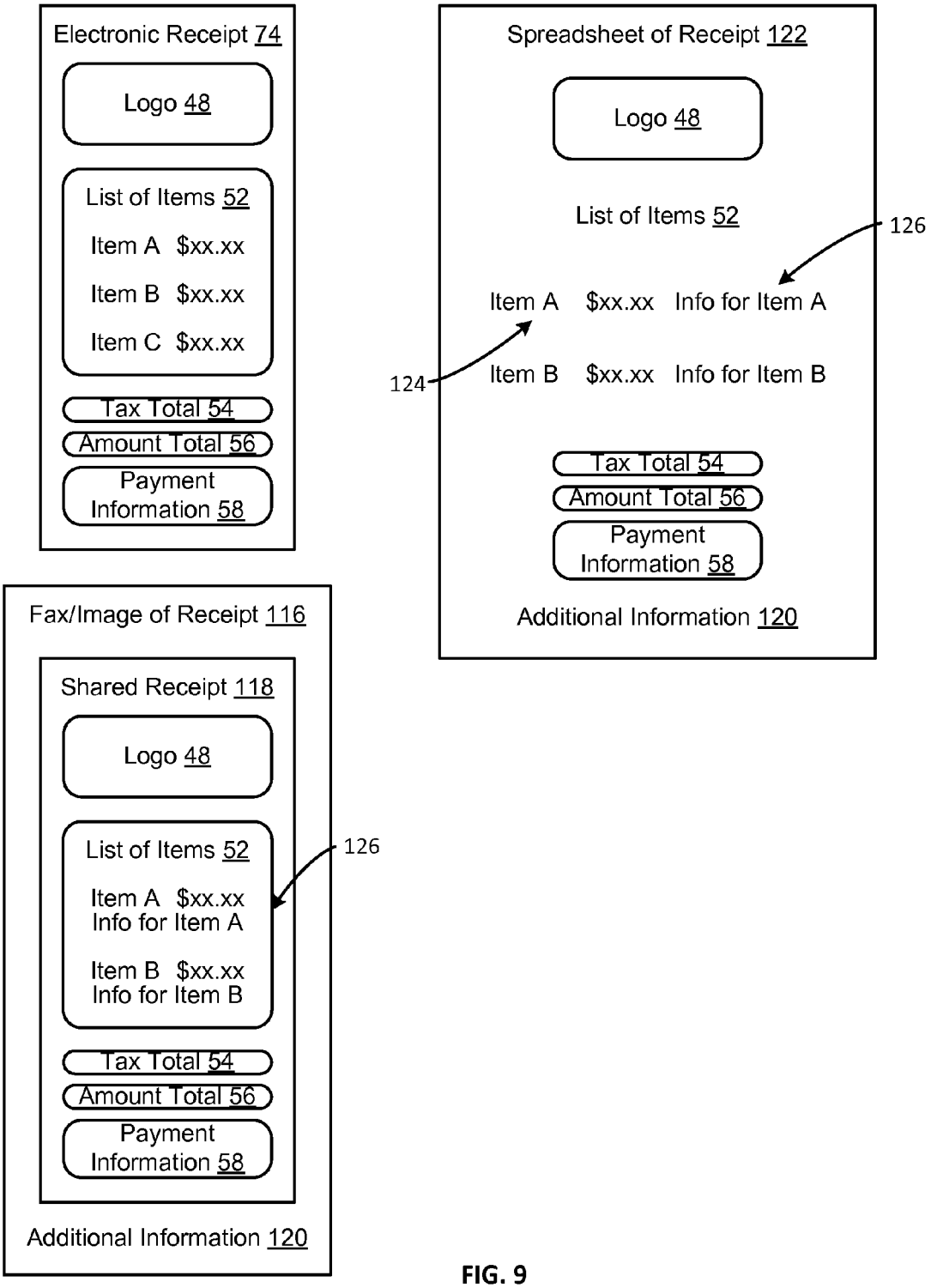
FIG. 9 shows schematic diagrams of various receipts according to the present invention.

Referring to FIG. 9, receipts which have been shared according to the present system are shown. An electronic receipt 74 may have been obtained by a customer who has elected to receive electronic receipts. The customer may desire to share this receipt as discussed. Accordingly, an image of the receipt may be send as a PDF via email or as a fax transmission 116 presenting a shared copy 118 of the receipt. Additional information 120 and additional item information 126 may be created and shared with the contact person associated with the sharing profile created by the customer. Rather than the receipt image, a receipt may be shared in a data format such as an electronic file or a spreadsheet 122. The spreadsheet may contain item information 124 as well as addition information 126 associated with the item and additional information 128 associated with the receipt.

Figure 10:
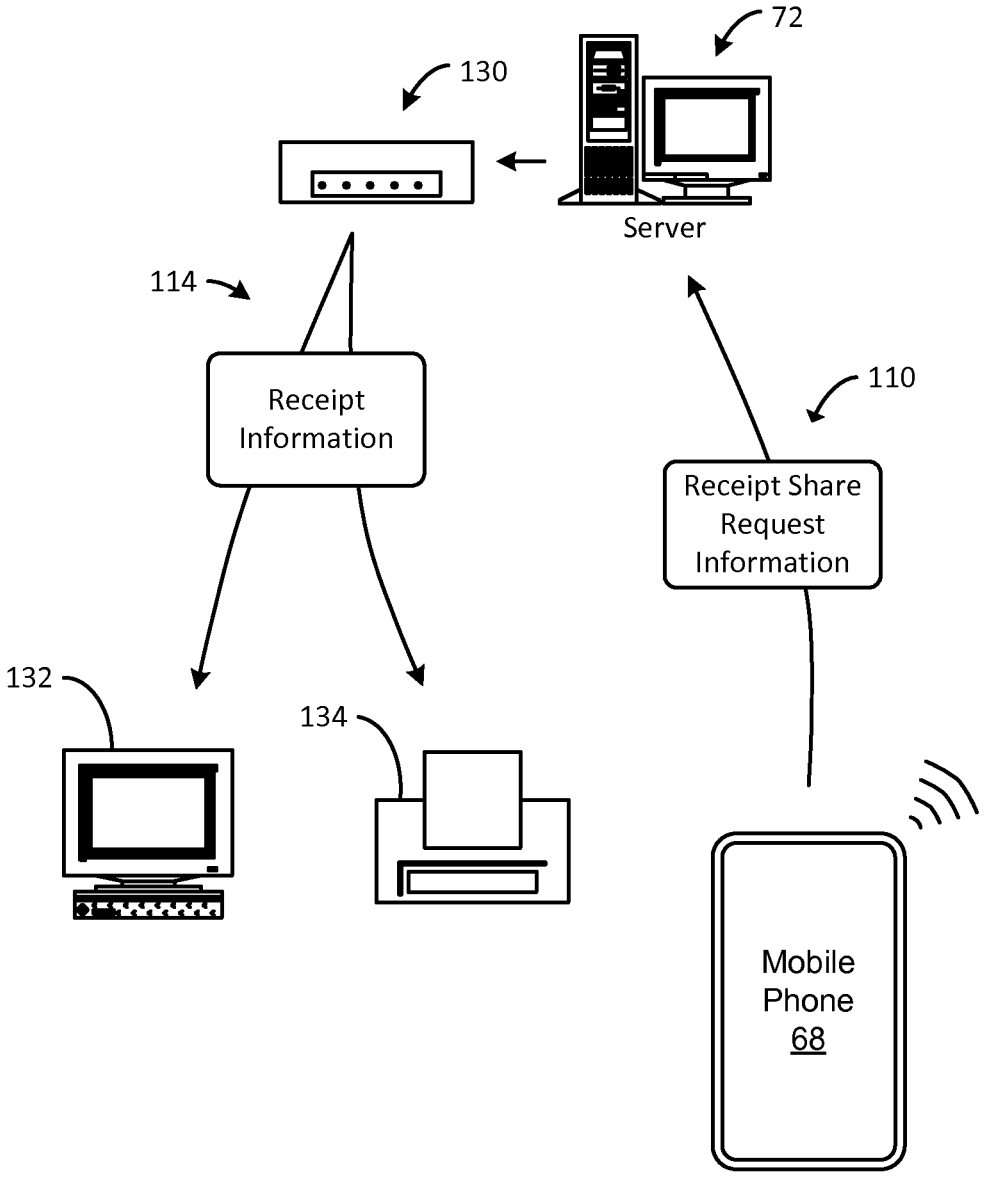
FIG. 10 is a block diagram illustrating the flow of data within one embodiment of system in accordance with the present invention.

Referring now to FIG. 10, an exemplary general flow of information for sharing receipts is shown. After the customer has identified 104 a receipt for sharing and selected 136 sharing options associated with that receipt, the mobile electronic device 68 will typically send 110 receipt information to a server 26, 34, 72 over the mobile electronic device network. The receipt information will contain the information necessary to request sharing the receipts and will contain any information necessary for modifying the receipt or sharing the receipt in a particular format or with associated data.

The server 26, 34, 72 may then process 112 the receipt sharing request and prepare the receipt information and associated information in the desired format. When the server has completed any necessary processing of the receipt and associated information, the server may use a communications device 130 to send 114 the shared receipt information to the desired contact person. The server may send 114 the receipt data to a computer 132 or a fax machine 134 as indicated by the customer, typically in the stored information associated with the sharing profile.

Figure 11:
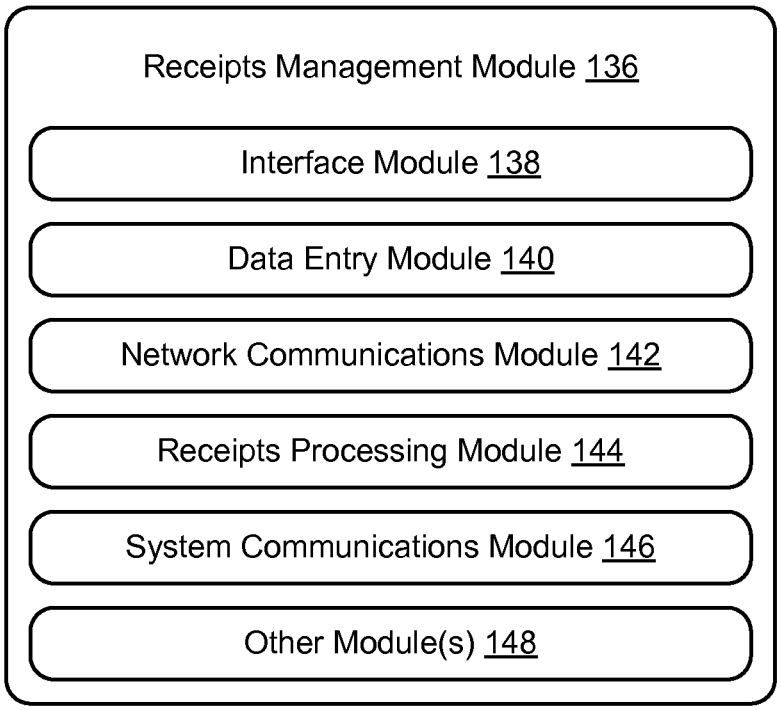
FIG. 11 is a schematic block diagram of one embodiment of a receipts sharing module in accordance with the present invention.

Referring to FIG. 11, a computer system in accordance with the present invention may include a receipts management module 136. The various functions or modules of a receipts management module 136 may be enacted or implemented by any suitable system or component thereof. For example, in selected embodiments, one or more functions or modules of a receipts management module 136 may be distributed across one or more hardware devices, including a mobile electronic device 68, a primary computer 12 of a POS system 10, a local server 26, a supervisory server 34 or 72, some other onsite resource, some other offsite resource, or the like or combinations or sub-combinations thereof. Thus, systems and methods in accordance with the present invention may be adapted to a wide variety of situations, including more rigid legacy systems.

In selected embodiments, a receipts management module 136 facilitates the receipts printing process described herein. The receipts management module may include any suitable arrangement of sub-components or modules. The receipts management module 136 may include an interface module 138 which interfaces with a customer. The interface module may include a display on a mobile electronic device 68. The receipts management module 136 may also include a data entry module 140 which may include a keypad or touch-screen on a mobile electronic device 68 and which allows the customer to enter data associated with a receipt sharing profile or with a particular receipt or item on the receipt. The receipts management module 136 may include a network communications module 142 which may facilitate communications between the mobile electronic device 68 and the server 26, 34, 72.

The receipts management module 136 may include a receipts processing module 144 which may include a server 72 and which may facilitate processing receipts and preparing receipts for sharing. The receipts management module 136 may include a system communications module 146 which may communicate between a server 26, 34, 72 and a contact person associated with a receipts sharing profile, such as by way of a computer 132 or fax machine 134 associated with that person. The system communications module may include a communications device 130 and may transmit receipt information from the server to the contact person. The receipts management module 136 may also include other modules 148 as are desirable to implement aspects of the present invention. The various modules and parts of the mobile self-checkout module 136 may include both hardware, firmware and software components as are desirable to accomplish the present invention and to achieve the various steps, features, and functionality discussed herein.

The flowchart and block diagrams of the Figures illustrate the architecture, functionality, and operation of possible implementations of systems, methods, and computer program products according to one or more embodiments of the present invention. In this regard, each block in the flowchart or block diagrams may represent a module, segment, or portion of code, which comprises one or more executable instructions for implementing the specified logical function (s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

It should also be noted that, in some alternative implementations, the functions noted in the blocks may occur out of the order noted in the Figure. In certain embodiments, two blocks shown in succession may, in fact, be executed substantially concurrently, or the blocks may sometimes be executed in the reverse order, depending upon the functionality involved. Alternatively, certain steps or functions may be omitted if not needed.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A computer implemented method for sharing an electronic receipt comprising:

providing a receipts management system, with a computer system using one or more processors, in communication via a network with a mobile electronic device of a customer and with a POS sales system, the receipts management system comprising a receipts management server;

providing, with the computer system, an electronic receipts software for installation on the mobile electronic device of the customer, the electronic receipts software connecting with the POS sales system;

receiving, with the computer system, one or more electronic receipts by the mobile electronic device over the network for a first one or more items from the POS sales system in response to the customer purchasing the first one or more items;

initiating the electronic receipts software on the mobile electronic device;

receiving, with the computer system, from the mobile electronic device, a selection of the electronic receipt from the one or more electronic receipts, the electronic receipt being stored on the electronic receipts software on the mobile electronic device;

receiving, with the computer system, from the mobile electronic device, a purpose for submitting a modified version of the electronic receipt;

automatically prompting, with the electronic receipts software, the customer to select an option to share the electronic receipt with one or more contacts in one or more customer sharing profiles stored on the electronic receipts software, the automatic prompting based on a history of the customer having shared with the one or more contacts modified versions of one or more other receipts having similar ones of one or more items on the electronic receipt;

receiving, from the mobile electronic device, a selection of a contact person from the one or more customer sharing profiles on the mobile electronic device, wherein the contact person is an accountant or a co-worker of the customer;

receiving, from the mobile electronic device, an indication to share the modified version of the electronic receipt with the contact person with instructions by the customer to modify an original receipt comprising at least one of:

adding reasons for submission of the electronic receipt next to at least one of the one or more items on the electronic receipt;

adding purchase codes next to at least one of the one or more items on the electronic receipt;

redacting at least one of the one or more items on the electronic receipt; or adding a business message for the contact person regarding the electronic receipt;

preparing, with the computer system, the modified version of the electronic receipt in accordance with the instructions from the customer including transforming the electronic receipt into a specified format for the modified version of the electronic receipt, wherein the specified format comprises at least one of an image, a data string, a delimited structured data set, or a spreadsheet; and sending, with the computer system, the modified version of the electronic receipt by email or facsimile to the contact person, as selected, from the one or more customer sharing profiles over the network.

2. The computer implemented method of claim 1, further comprising receiving a selection of a portion of the one or more items on the electronic receipt and wherein the modified version of the electronic receipt is redacted to show only the portion of the one or more items of the electronic receipt.

3. The computer implemented method of claim 2, further comprising receiving a selection of an item from the electronic receipt for sharing with the contact person.

4. The computer implemented method of claim 1, wherein the electronic receipt is printed as a paper receipt in a different format.

5. The computer implemented method of claim 1, further comprising:

sending additional information regarding the electronic receipt over the network to the mobile electronic device; and sending the additional information over the network to the contact person, as selected.

6. The computer implemented method of claim 5, wherein:

the additional information relates to an item on the electronic receipt; and the receipts management server modifies the electronic receipt to associate the additional information with the item.

7. The computer implemented method of claim 1, wherein the modified version of the electronic receipt includes an additional description of an item on the electronic receipt.

8. The computer implemented method of claim 1, wherein the modified version of the electronic receipt includes additional tax information regarding an item on the electronic receipt.

9. The computer implemented method of claim 1, wherein the modified version of the electronic receipt is printed as a spreadsheet.

10. The computer implemented method of claim 1, wherein the modified version of the electronic receipt is presented as delimited data comprising XML or csv data.

11. The computer implemented method of claim 1, wherein the modified version of the electronic receipt includes work reimbursement codes associated with a workplace of the customer.

12. The computer implemented method of claim 1 wherein the modified version of the electronic receipt includes contact information for the customer.

13. The computer implemented method of claim 1, wherein:

the mobile electronic device comprises a receipt sharing profile corresponding to the contact person; and the modified version of the electronic receipt is modified according to information in the receipt sharing profile.

14. The computer implemented method of claim 1, wherein the modified version of the electronic receipt includes a message or instruction to the contact person from the customer.

15. The computer implemented method of claim 1, wherein sending the modified version of the electronic receipt to the contact person comprises the receipts management server sending receipt information over the network to the contact person via a format selected from a group consisting of an electronic facsimile, a computer data storage medium, or email.

16. The computer implemented method of claim 1, further comprising the receipts management server sending information from the electronic receipt over the network to the contact person at a workplace of the customer in response to the customer purchasing an item for work and receiving the electronic receipt.

17. A computer program product for use at a mobile electronic device of a customer, the mobile electronic device having an electronic receipts software installed on the mobile electronic device, wherein a receipts management module is in communication with one or more mobile electronic devices and a POS sales system via a network for managing electronic receipts of the customer, the one or more mobile electronic devices comprising the mobile electronic device of the customer, the computer program product implementing a method of sharing an electronic receipt of the customer comprising:

receive one or more of the electronic receipts for one or more items from the POS sales system in response to the customer purchasing the one or more items;

initiate the electronic receipts software on the mobile electronic device;

receive, from the mobile electronic device, a selection of the electronic receipt from the one or more of the electronic receipts, the electronic receipt being stored on the electronic receipt software on the mobile electronic device;

receive, from the mobile electronic device, a purpose for submitting a modified version of the electronic receipt;

automatically prompting, with the electronic receipts software, the customer to select an option to share the electronic receipt with one or more contacts in one or more customer sharing profiles stored on the electronic receipts software, the automatic prompting based on a history of the customer having shared with the one or more contacts modified versions of one or more other receipts having similar ones of one or more items on the electronic receipt;

receive, from the mobile electronic device, a selection of a contact person from the one or more customer sharing profiles on the mobile electronic device, wherein the contact person is an accountant or a co-worker of the customer;

receive, from the mobile electronic device, an indication to share the modified version of the electronic receipt with the contact person with instructions by the customer to modify an original receipt comprising at least one of:

adding reasons for submission of the electronic receipt next to at least one of the one or more items on the electronic receipt;

adding purchase codes next to at least one of the one or more items on the electronic receipt;

redacting at least one of the one or more items on the electronic receipt; or adding a business message for the contact person regarding the electronic receipt;

preparing the modified version of the electronic receipt or extracting information from the electronic receipt in accordance with the instructions from the customer including transforming the electronic receipt into a specified format for the modified version of the electronic receipt, wherein the specified format comprises at least one of an image, a data string, a delimited structure data set, or a spreadsheet; and sending the modified version of the electronic receipt or the information, as extracted from the electronic receipt, by email or facsimile to the contact person, as selected, from the one or more customer sharing profiles over the network.

18. A computer system comprising:

a POS sales system comprising one or more processors and one or more non-transitory storage modules, the POS sales system for producing one or more electronic receipts in response to a customer purchasing one or more items;

a receipt data server comprising one or more processors and one or more non-transitory storage modules, the receipt data server in communication with one or more mobile electronic devices and the POS sales system via a network;

an electronic receipts software for installation on a mobile electronic device of the one or more mobile electronic devices, and a receipts management module of the receipt data server for managing the one or more electronic receipts of the customer, wherein the receipts management module for the mobile electronic device is configured to:

receive one or more of the one or more electronic receipts for the one or more items of the customer from the POS sales system;

initiate the electronic receipts software on the mobile electronic device;

receive, from the mobile electronic device, a selection of an electronic receipt from the one or more electronic receipts, the electronic receipt being stored on the electronic receipt software on the mobile electronic device;

receive, from the mobile electronic device, a purpose for submitting a modified version of the electronic receipt or information from the electronic receipt;

automatically prompt the customer to select an option to share the electronic receipt with one or more contacts in one or more customer sharing profiles stored on the electronic receipts software, the automatic prompting based on history of the customer having shared with the one or more contacts modified versions of one or more other receipts having similar ones of one or more items on the electronic receipt;

receive, from the mobile electronic device, a selection of a contact person from the one or more customer sharing profiles on the mobile electronic device, wherein the contact person is an accountant or a co-worker of the customer;

receive, from the mobile electronic device, an indication to share the modified version of the electronic receipt or the information from the electronic receipt with the contact person with instructions by the customer to modify an original receipt comprising at least one of:

adding reasons for submission of the electronic receipt next to at least one of the one or more items on the electronic receipt;

adding purchase codes next to at least one of the one or more items on the electronic receipt;

redacting at least one of the one or more items on the electronic receipt; or adding a business message for the contact person regarding the electronic receipt;

prepare the modified version of the electronic receipt or extracting information from the electronic receipt in accordance with the instructions from the customer including transforming the electronic receipt into a specified format for the modified version of the electronic receipt, wherein the specified format comprises at least one of an image, a data string, a delimited structure data set, or a spreadsheet; and send the modified version of the electronic receipt or the information from the electronic receipt by facsimile or email to the contact person, as selected, from the one or more customer sharing profiles over the network.

19. The computer implemented method of claim 1, further comprising:

receiving a selection of a portion of the one or more items on the electronic receipt, wherein the modified version of the electronic receipt is redacted to show only the portion of the one or more items of the electronic receipt;

receiving a selection of an item from the electronic receipt for sharing with the contact person;

sending additional information regarding the electronic receipt over the network to the mobile electronic device; and sending the additional information over the network to the contact person, as selected, wherein:

the additional information relates to an item on the electronic receipt;

the receipts management server modifies the electronic receipt to associate the additional information with the item;

the modified version of the electronic receipt includes an additional description of an item on the electronic receipt;

the modified version of the electronic receipt includes additional tax information regarding an item on the electronic receipt;

the modified version of the electronic receipt is printed as a spreadsheet; and the modified version of the electronic receipt is presented as delimited data comprising XML or csv data.

20. The computer implemented method of claim 1, wherein:

the modified version of the electronic receipt includes work reimbursement codes associated with a workplace of the customer;

the modified version of the electronic receipt includes contact information for the customer;

the mobile electronic device comprises a receipt sharing profile corresponding to the contact person;

the modified version of the electronic receipt is modified according to information in the receipt sharing profile;

sending the modified version of the electronic receipt comprises sending a message to the contact person from the customer; and the receipts management server sending information from the electronic receipt over the network to the contact person at a workplace of the customer in response to the customer purchasing an item for work and receiving the electronic receipt.

21. The computer implemented method of claim 1, further comprising:

receiving, with the computer system, multiple receipts for sharing within a given time period.

22. The computer program product of claim 17, wherein the method of sharing the electronic receipt of the customer further comprises:

receiving multiple receipts for sharing within a given time period.

23. The computer system of claim 18, wherein the receipts management module for the mobile electronic device is further configured to:

receive multiple receipts for sharing within a given time period.

24. The computer implemented method of claim 1, further comprising:

modifying a version of the electronic receipt transformed in varying formats, wherein:

if the modified version of the electronic receipt is shared as the image, then codes or information associated with a particular item on the electronic receipt are printed on the electronic receipt next to the item; or if the modified version of the electronic receipt is shared as the data string, the delimited structured data set, or the spreadsheet, then the codes or the information associated with the particular item are printed in a cell or data value adjacent to the particular item.

25. The computer program product of claim 17, wherein the method of sharing the electronic receipt of the customer further comprises:

modifying a version of the electronic receipt transformed in varying formats, wherein:

if the modified version of the electronic receipt is shared as the image, then codes or information associated with a particular item on the electronic receipt are printed on the electronic receipt next to the particular item; or if the modified version of the electronic receipt is shared as the data string, the delimited structured data set, or spreadsheet, then the codes, or the information associated with the particular item are printed in a cell or data value adjacent to the particular item.

26. The computer system of claim 18, wherein the receipts management module for the mobile electronic device is further configured to:

the modified version of the electronic receipt transformed in varying formats, wherein:

if the modified version of the electronic receipt is shared as an image, then codes, or information associated with a particular item on the electronic receipt are printed on the electronic receipt next to the particular item; or if the modified version of the electronic receipt is shared as the data string, the delimited structured data set, or spreadsheet, then the codes or information associated with the particular item are printed in a cell or data value adjacent to the particular item.

* * * * *